US005098314A

United States Patent [19]

Castagna et al.

[11] Patent Number: 5,098,314

[45] Date of Patent: Mar. 24, 1992

[54] EYELET TERMINATION FOR COAXIAL CABLE

[75] Inventors: Lou Castagna; Richard E. Rothenberger, both of Harrisburg, Pa.

[73] Assignee: AMP Incorporated, Harrisburg, Pa.

[21] Appl. No.: 707,479

[22] Filed: May 30, 1991

[51] Int. Cl.[5] ..... H01R 17/04

[52] U.S. Cl. ..... 439/578; 439/579; 439/874; H01R/17/04

[58] Field of Search ..... 439/98, 99, 578–585, 439/675, 877, 879, 874; 29/862, 863, 857

[56] References Cited

U.S. PATENT DOCUMENTS 2,570,800 10/1951 Ham ..... 439/99
3,551,882 12/1970 O'Keefe ..... 439/585
3,599,166 5/1971 Cea ..... 439/585
4,447,100 5/1984 Dyce et al. ..... 29/862
4,558,918 12/1985 Shores ..... 439/579
4,688,878 8/1987 Cohen et al. ..... 439/585
4,889,500 12/1989 Lazar et al. ..... 439/579

*Primary Examiner*—David L. Pirlot
*Attorney, Agent, or Firm*—Gerald K. Kita

[57] ABSTRACT

An electrical contact (26) for joining a ground wire (5) of a coaxial cable (1) to an electrical connector comprises, a first ring (27) assembled concentrically over a coaxial cable (1), a conductive second ring (28) assembled over the first ring (27) and clamped against a ground wire (5) of the cable (1), and the second ring (28) being joined conductively to a conductive ground contact (10) of the connector.

6 Claims, 3 Drawing Sheets

EYELET TERMINATION FOR COAXIAL CABLE

FIELD OF THE INVENTION

The invention pertains to an electrical contact for termination of a ground wire of an electrical cable.

BACKGROUND OF THE INVENTION

A coaxial cable includes a signal wire encircled concentrically by a dielectric of insulative material, a conductive sheath concentrically encircling the dielectric and a ground wire extending axially along the sheath. an outer, insulative jacket covers the ground wire and the sheath.

A coaxial cable is connected with an electrical connector as disclosed in U.S. Pat. No. 4,875,877. The connector includes a conductive signal contact for connection to a signal wire of a corresponding coaxial cable, and a conductive ground bus for connection to the ground wire, also called a drain wire. To connect the ground wire to the ground bus, the ground wire must be positioned along a wire receiving channel of the connector. Often times the ground wire is located in an awkward position, and requires a skilled person to bend the ground wire to a desired orientation for receipt by the connector.

SUMMARY OF THE INVENTION

The invention pertains to an electrical contact for termination of a ground wire of a coaxial cable. An advantage of the invention resides in an electrical contact that grips a ground wire of a coaxial cable in an expedient manner without a need to bend the ground wire to a desired position. Electrical connection is made by welding or soldering, or otherwise joining, the electrical contact to a ground bus or other type of electrical ground contact of an electrical connector. The joined contact provides a larger target than the ground wire for a weld joint or a solder joint. Accordingly, the larger contact can be joined to a ground contact instead of having to orient the awkwardly positioned ground wire for joining to the ground contact.

According to the invention, an electrical contact for joining a ground wire of a coaxial cable to an electrical connector comprises, a first ring assembled concentrically over a coaxial cable, a conductive second ring assembled over the first ring and clamped against a ground wire of the cable, and the second ring being joined conductively to a conductive ground contact of the connector.

A method for connecting an electrical coaxial cable to a connector comprises the steps of: assembling a first ring concentrically over a coaxial cable, applying a conductive second ring concentrically over the first ring to clamp on a conductive ground wire of the cable, joining the second ring to a ground contact of the connector, and joining a signal wire of the cable to a corresponding signal contact of the connector.

For an understanding of the invention, reference will now be made to the following detailed description of a preferred embodiment, by way of example, in conjunction with the accompanying drawings, according to which;

DETAILED DESCRIPTION OF A PREFERRED EMBODIMENT

Figure 1:
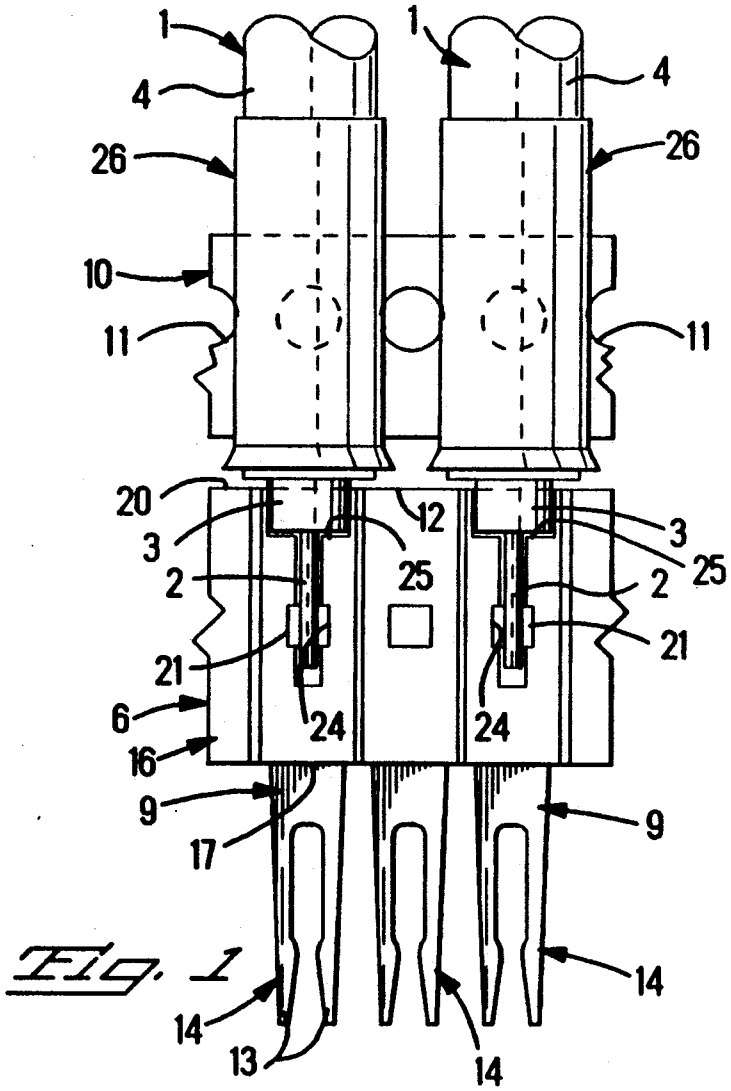
FIG. 1 is a plan view of a portion of an electrical connector and electrical cables connected to the connector.
Figure 3:
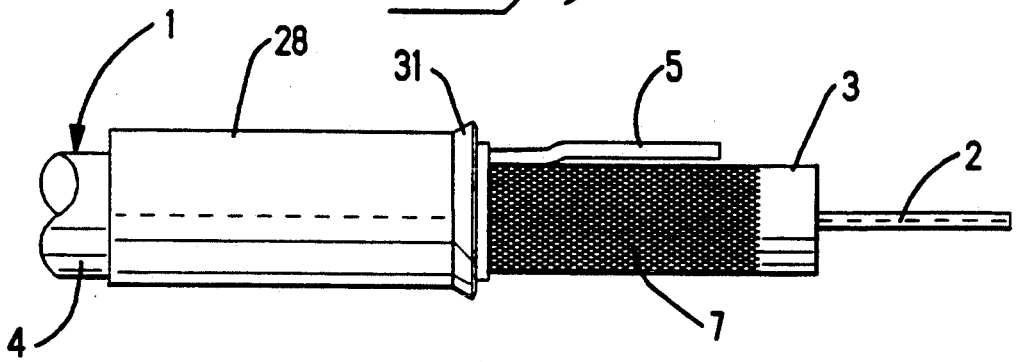
FIG. 3 is an elevation view of a portion of an electrical cable together with a conductive ring.

With reference to FIG. 1, an electrical coaxial cable 1 is constructed with an elongated signal wire 2 or center conductor encircled concentrically by an insulative sheath 3, also called a dielectric 3, in turn, encircled concentrically by a flexible and insulative outer jacket or sheath 4. An elongated and conductive ground wire 5 or drain wire extends along the exterior of the dielectric 3 and is within the jacket 4 or sheath. A conductive sheath 7 or shield concentrically encircles the dielectric 3. The cable construction is cut to expose the signal wire 2, the dielectric 3 and the ground wire 5 from the jacket 4, as shown in FIG. 1.

With reference to FIG. 1, an electrical connector 6, also called an electrical connector assembly 6, is connected to one or more corresponding cables 1. Each of multiple signal contacts 9 in a row are forwardly of a corresponding, separate, electrical ground contact 10, for example, a ground bus provided with a series of spaced apart pilot holes 11. The signal contacts 9 and the ground contact 10 are cut out from corresponding strips of metal. Selected, alternate ones of the signal contacts 9 in the row are connected to corresponding signal wires 2. Other alternate ones of the signal contacts 9 overlap the ground contact 10 at an overlap 12, FIG. 2, and are connected to the ground contact 10 by welding. The contacts 9 will then be in a pattern of ground, signal, ground. Each of the signal contacts 9 includes a pair of spaced apart fingers 13 defining an electrical receptacle 14 at a front end. The signal contacts 9 are on an insulative and unitary housing block 16 formed by injection molding plastics material that imbeds the contacts 9. A front end 17 of the housing block 16 extends transverse to the row of contacts 9 and imbeds the contacts 9 to the rear of the receptacles 14. The housing block 16 extends rearward of the front end 17 to a rear wall 20 from which the ground contact 10 projects. Wire connecting portions 21 of the contacts 9 appear at corresponding, spaced apart, openings 24 formed by molding the housing block 16. The signal wires 2 are aligned with corresponding wire connecting portions 21, and are joined by known welding or soldering operations to corresponding wire connecting portions 21. Wire receiving channels 25 formed by molding the housing block 16 extend from the rear wall 20 and forwardly and axially of corresponding contacts 9. Each wire receiving channel 25 receives a corresponding signal wire 2 and dielectric 3 of a cable 1.

Figure 4:
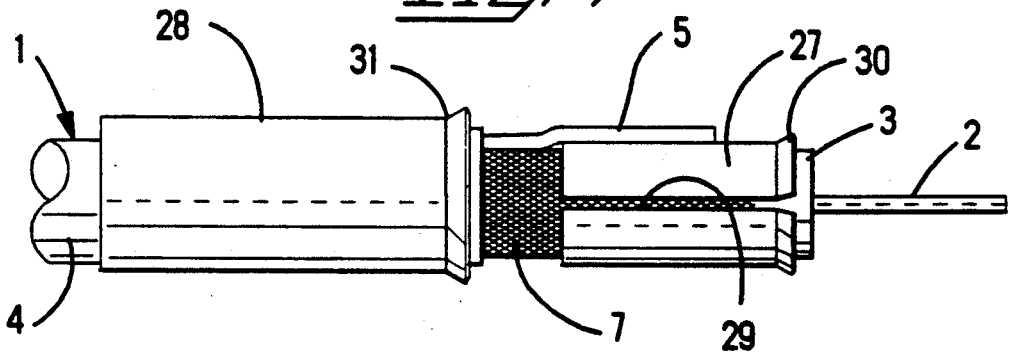
FIG. 4 is an elevation view of a portion of the cable and the conductive ring disclosed in FIG. 3 together with an inner ring assembled on the cable.
Figure 5:
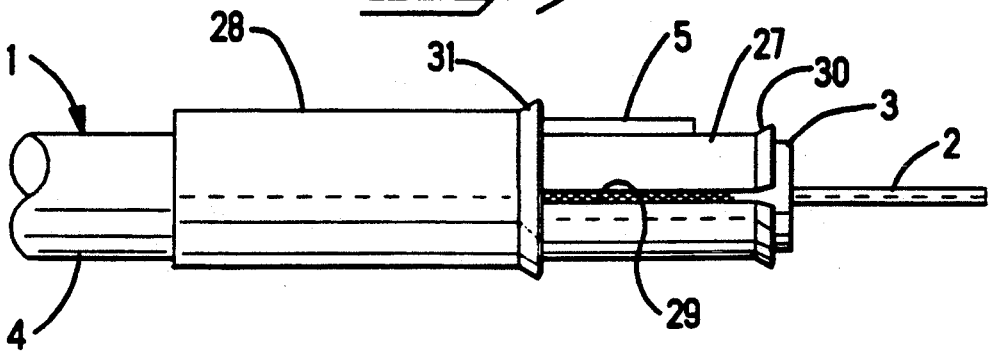
FIG. 5 is an elevation view of a portion of the cable and the rings disclosed in FIG. 4, with the conductive ring partially encircling the inner ring.

With reference to FIGS. 1, 3, 4, 5 and 6, each cable 1 is prepared with an electrical contact 26 comprising, a first, inner ring 27 and a second, outer ring 28. The contact 26 facilitates an electrical connection of the cable 1 to a corresponding electrical ground contact 10. Although, all the contacts 26 are shown as being connected to one ground contact 10, multiple ground contacts 10 can be connected, one to one corresponding contact 26. The outer ring 28 concentrically encircles the exterior of the cable 1 and is slid over the outer jacket 4 to a temporary position, shown in FIG. 3. The inner ring 27 concentrically encircles the dielectric 3 of the cable 1, as shown in FIG. 4. The inner ring 27 is split by a longitudinal, open seam 29 that allows the inner ring 27 to expand by resilient spring action to encircle and clamp the cable 1 constrictively. The ground wire 5 of the cable 1 extends to overlap the inner ring 27, and to overlie a substantial length of the inner ring 27. The outer ring 28 is slid forwardly, as shown in FIG. 5, over the inner ring 27, to concentrically encircle the inner ring 27, and to clamp against the drain wire 5. The outer ring 28 is conductive. The outer ring 28 directly engages the drain wire 5 to establish an electrical connection.

Figure 2:
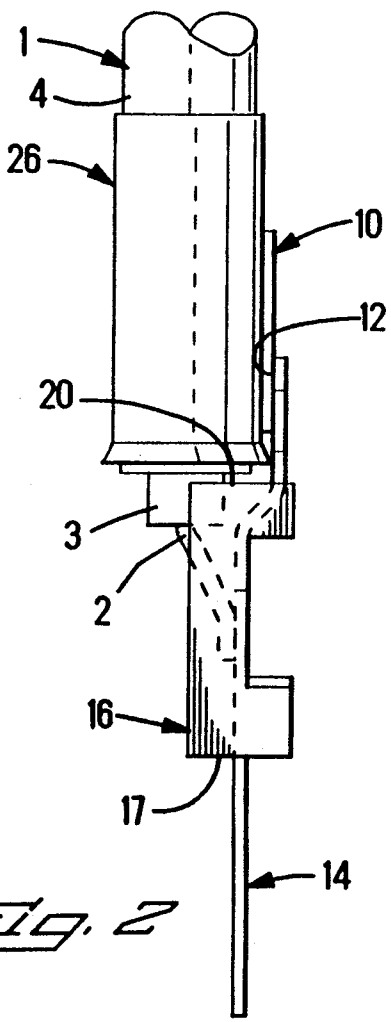
FIG. 2 is a side elevation view of the connector and cables disclosed in FIG. 1.
Figure 6:
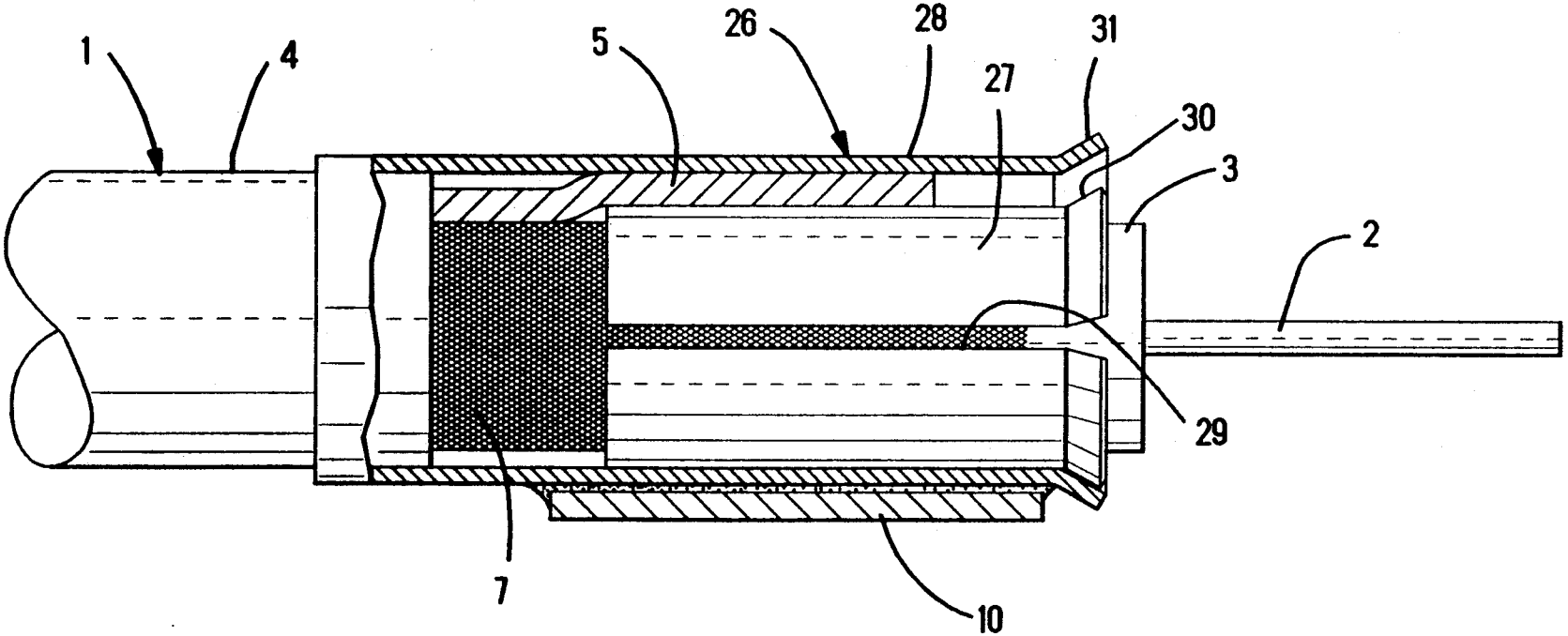
FIG. 6 is an enlarged section view of the cable and the rings disclosed in FIG. 5.

With reference to FIG. 5, considered in conjunction with FIG. 6, both rings 27, 28 have corresponding, forward facing, front ends with upturned lips 30, 31, one overlapping the other. The upturned lips 29, 30 align the rings 27, 28 with each other. The inner lip 29 is larger in diameter than the forward end of the outer ring 28, to limit forward passage of the outer ring 28 over the inner ring 27. The lips 30, 31 become aligned concentrically as an indicator that further forward movement of the outer ring 28 is not required. The lip 31 on its interior provides a flared, funnel entry for ease in passage forwardly over the cable 1 and over the inner ring 27. With reference to FIGS. 1 and 2, the outer ring 28 is positioned over the ground contact 10, and is joined conductively to the ground contact 10 by a solder joint or a weld joint, constructed according to known soldering operations or known welding operations.

An advantage of the invention resides in the electrical contact 26 that grips the ground wire 5 of the coaxial cable 1 in an expedient manner without a need to bend the ground wire 5 to a desired position. Electrical connection is made by welding or soldering, or otherwise joining, the electrical contact 26 to the electrical ground contact 10 of the electrical connector 6. The joined contact 26 provides a larger target than the ground wire 5 for a weld joint or a solder joint. Accordingly, the larger contact 26 can be joined to the ground contact 10 instead of having to orient the awkwardly positioned ground wire 5 for joining to the ground contact 10.

The inner ring 27 can be conductive. Thereby, the ground wire 5 would be clamped by both conductive rings 27, 28 of the contact 26 to ensure an electrical connection with the contact 26. The inner ring 27 also can encircle both the conductive sheath 7, and the dielectric 3 inside the conductive sheath 7. Thereby, the inner ring 27 clamps directly on, and constrictively on, the conductive sheath 7 of the cable 1, to establish an electrical connection of the contact to the sheath 7. The conductive rings 28, 29 provide a concentric conductive shield over the signal wire 2 and the dielectric, which connects directly to the corresponding ground contact 10.

In some construction of the cable 1, the ground wire 5 is encircled by the conductive sheath 7, not shown. The ground wire 5 can be extended to protrude from the sheath 7, or the sheath 7 can be cut so as to expose the ground wire 5 for direct contact by the outer ring 28.

A method for connecting the electrical coaxial cable 1 to a connector 6 comprises the steps of: assembling the first ring 27 concentrically over a coaxial cable 1, applying the conductive second ring 28 concentrically over the first ring 27 to clamp on the conductive ground wire 5 of the cable 1, joining the second ring 28 to a ground contact 10 of the connector 6, and joining the signal wire 2 of the cable 1 to a corresponding signal contact 9 of the connector 1.

We claim:

1. An electrical contact for joining a ground wire of a coaxial cable to an electrical connector comprising: a first ring assembled concentrically over a coaxial cable, a conductive second ring assembled over the first ring and clamped against a ground wire of the cable, the first ring and the second ring having upturned lips, one overlapping the other, and the second ring being joined conductively to a conductive ground contact of the connector.

2. An electrical contact as recited in claim 1, wherein the first ring is split and constrictively encircles the cable.

3. An electrical contact as recited in claim 1, wherein the first ring is conductive and engages a conductive sheath of the cable.

4. An electrical contact as recited in claim 1, wherein the second ring is joined conductively by a weld joint.

5. An electrical contact as recited in claim 1, wherein the second ring is joined conductively by a solder joint with the ground contact.

6. An electrical contact as recited in claim 1, wherein the first ring is compressively engaged on a conductive sheath of the cable.

* * * * *